US007347756B1

(12) United States Patent
Candler

(10) Patent No.: US 7,347,756 B1
(45) Date of Patent: Mar. 25, 2008

(54) SURFBOARD

(76) Inventor: Robert A. Candler, 11359 Dorchester Dr., Truckee, CA (US) 96162

( * ) Notice: Subject to any disclaimer, the term of this patent is extended or adjusted under 35 U.S.C. 154(b) by 0 days.

(21) Appl. No.: 11/739,600

(22) Filed: Apr. 24, 2007

Related U.S. Application Data

(63) Continuation-in-part of application No. 11/422,490, filed on Jun. 6, 2006.

(51) Int. Cl.
*A63C 5/03* (2006.01)

(52) U.S. Cl. ..... 441/74

(58) Field of Classification Search ..... 441/74
See application file for complete search history.

(56) References Cited

U.S. PATENT DOCUMENTS 3,323,154 A * 6/1967 Lambach ..... 441/74

4,507,094 A * 3/1985 Hennebutte ..... 441/65

* cited by examiner

*Primary Examiner*—Stephen Avila
(74) *Attorney, Agent, or Firm*—Sierra Patent Group, Ltd.

(57) ABSTRACT

A surfboard for use by riders on bodies of water is disclosed having first and second apertures extending through the surfboard from the bottom side to the top side, angled such that each aperture has a first opening on the bottom side and extends at an angle toward the tail end of the surfboard to a second opening on the top side of the surfboard. A first channel disposed within a portion of the bottom side of the surfboard, terminating at the first opening of the first aperture, and a second channel disposed within a portion of the bottom side of the surfboard, and terminating at the first opening of the second aperture, the first channel and second channel separated by a raised portion of the bottom side, thus defining a trimeran profile on the bottom side, the trimeran profile having a first and second rail, and a center portion.

16 Claims, 2 Drawing Sheets

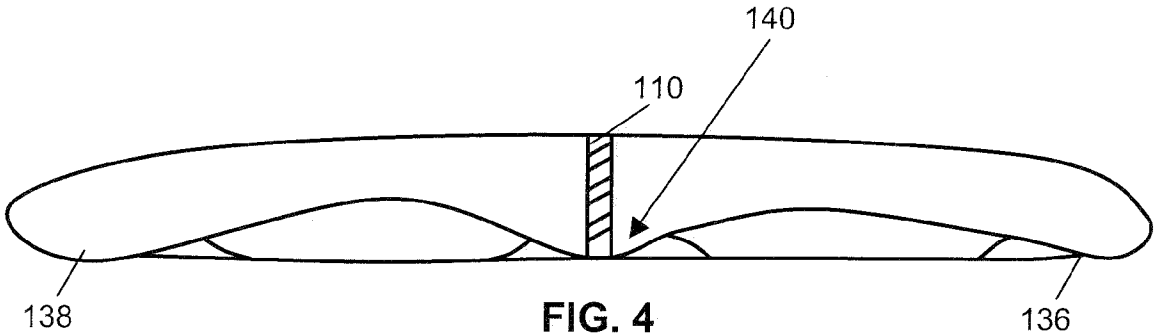
FIG. 4
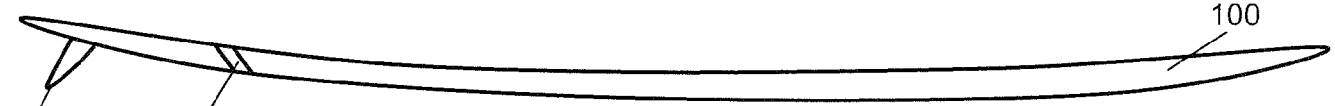
FIG. 3
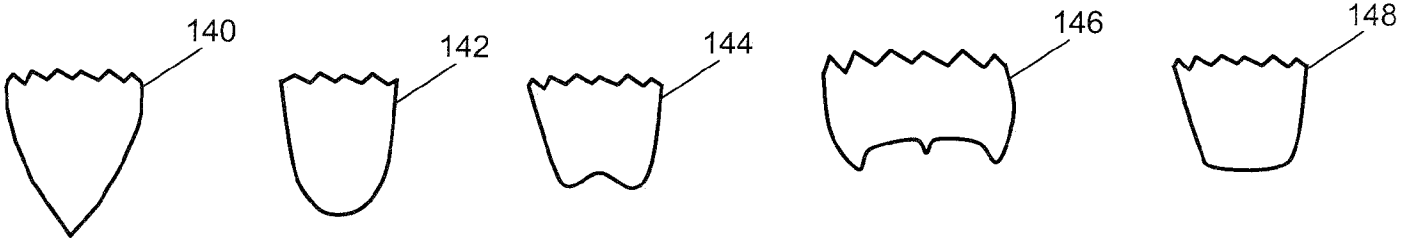
FIG. 5
FIG. 6
FIG. 7
FIG. 8
FIG. 9

SURFBOARD

CROSS-REFERENCE TO RELATED APPLICATIONS

This application is a continuation-in-part of U.S. patent application Ser. No. 11/422,490, filed Jun. 6, 2006, incorporated by reference in its entirety.

FIELD

The present invention relates broadly to surfboards. Specifically, the present invention relates to surfboards having apertures located near the tail end of the surfboard.

BACKGROUND

Experimentation in surfboard design dates back to the 1940s, when surfing first gained worldwide popularity in Hawaii. There have been many types of designs, beginning with the long board. The long board, typically between 7 and 11 feet long, is a heavy surfboard that usually incorporates a single fin, called a skag, in the center of the tail of the surfboard. Longboards are especially useful for riding small waves, as well as big waves, because of their stability. However, because of their length (and often their girth as well) longboards suffer from a lack of maneuverability.

Since the early 80's, the most popular surfboard design has been the high performance shortboard, also known as a thruster. A thruster is much more maneuverable than a longer board, and often incorporates more than one skag at the tail end of the board. While thrusters are maneuverable, they also require more physical strength to ride than the typical longboard. Thrusters are thinned down as much as possible creating a board that lacks floatation and offering poor paddling ability. They can be very difficult to catch waves on and, unless you're a surfer of considerable skill, shortboards prove to be very difficult to ride in weak/small surf. These boards are designed for performance minded surfers and are designed for quality surf. Thrusters need to be turned continuously to generate speed and allow surfers to perform many tricks, including airs, tail slides, floaters, reverses, etc. The shortboard design is more appropriate for the intermediate level to advanced level surfer and is not used by a beginner.

The designs of the longboard and the shortboard thruster have changed very little over the last 40 years, aside from shaping and styling differences. Long boards still typically use one scag, and aside from different tail designs and slight changes to materials, have remain relatively unchanged otherwise. Likewise, thrusters haven't changed much in the last 20 years. Aside from minor style and materials changes, and the appearance of channels on the bottom side of the board, thrusters still appear as they did in 1981.

There remains a heartfelt need for improvements to the basic designs of available surfboards. A design that incorporates the stability of the longboard with the maneuverability of a shortboard would be a tremendous leap forward in the evolution of surfboard design.

SUMMARY OF THE INVENTION

The present invention addresses the shortcomings of the surfboard designs discussed above by presenting a surfboard that incorporates a plurality of channeled through-apertures at the tail end of the surfboard. By allowing water to pass through these apertures, the tail of the surfboard in accordance with the present invention is at least partially submerged; thus, the tail of the surfboard acts as a skag and presents a significantly different feel to making turns on a surfboard. In the preferred embodiment, at least one conventional skag is still used, and multiple skags can be implemented in various embodiments. Also in the preferred embodiment, the channeled apertures are angled with the bottom opening of the aperture forward of the top opening of the aperture, such that the apertures act as scoops to channel water from underneath the surfboard through the aperture and out over the tail end of the top surface of the surfboard. The channeled apertures of the present invention can be used with many different tail designs, such as a pin tail, a fish tail, a flat tail, and other designs.

In another aspect, the present invention provides a plurality of channels arranged longitudinally through the bottom surface of the surfboard, aligned with the apertures such that each channel directs water toward the center of the aperture as the surfboard passes over the water. In the preferred embodiment, two apertures incorporated in the tail end of the surfboard, and two channels are also incorporated, giving the bottom surfboard a trimeran profile that enables the surfer to achieve greater maneuverability and tighter turns and cutbacks. Other features and advantages of the present invention will become apparent from reading the following detailed description, when considered in conjunction with the drawings, in which:

BRIEF DESCRIPTION OF THE DRAWINGS

FIG. 3 is a plan view of the bottom side of the surfboard of FIG. 2;

FIG. 4 is an elevation view of the front end of the surfboard of FIG. 2;

FIG. 5 illustrates a pin tail design for the surfboard of the present invention;

FIG. 6 illustrates a round tail design for the surfboard of the present invention;

FIG. 7 illustrates a fish tail design for the surfboard of the present invention;

FIG. 8 illustrates a bat tail design for the surfboard of the present invention; and FIG. 9 illustrates a flat tail design for the surfboard of the present invention.

DETAILED DESCRIPTION OF THE INVENTION

Figure 1:
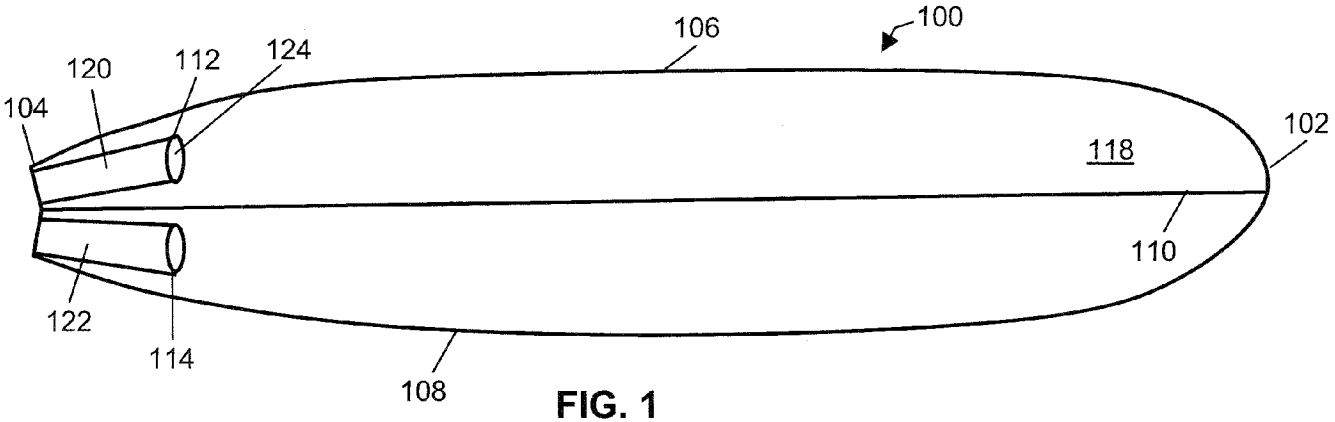
FIG. 1 is a plan view of the top side of the surfboard of the present invention.

Directing attention to FIG. 1, surfboard 100 is generally defined by a length disposed between front end 102 and tail end 104, and a width disposed between left side 106 and right side 108. In an embodiment, centerline 110 runs the length of surfboard 100. Apertures 112 and 114, located near tail end 104, are disposed symmetrically about centerline 110, a wooden spline that runs the along the center of surfboard 100. While the embodiment shown in FIG. 1 illustrates two apertures, a single aperture or more than two apertures can also be used in accordance with the present invention.

Figure 2:
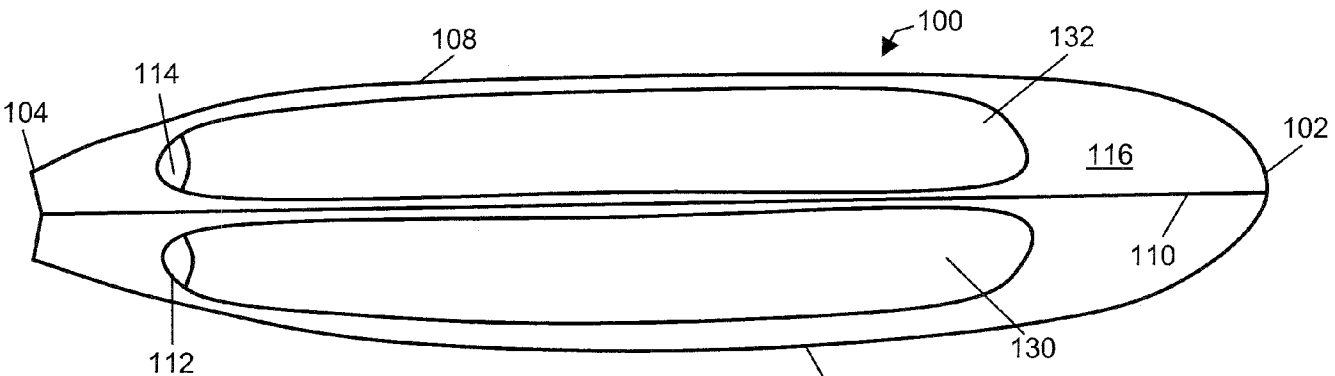
FIG. 2 is an elevation view of the surfboard of the present invention.

Apertures 112, 114 are through apertures, extending from bottom side 116 to top side 118. In an embodiment, behind apertures 112, 114 and extending to tail end 104 are disposed channels 120, 122. Channels 120, 122 are formed as slight depressions in top side 118 and direct water passing through apertures 112, 114 to pass over tail end 104. Directing attention to FIG. 2, aperture 112 is shown disposed at an angle within surfboard 100, such that water can be directed through aperture 112 as surfboard 100 moves forward across the surface of a body of water. As shown, the angle of apertures 112, 114 are such that horizontal clearance 124 is present (as shown in FIG. 1). However, other angles can be implemented in different embodiments, depending on user preference.

Directing attention to FIG. 3, on bottom side 116, the openings of apertures 112, 114 begin approximate 12.5 inches from tail end 104 and are symmetrically disposed with respect to skag 129. Channels 130, 132 extending a portion of the length of surfboard 100 and terminating at the openings of apertures 112, 114 that appear on bottom side 116, channels 130, 132 direct water to apertures 112, 114 as surfboard passes over the water, thus directing water through apertures 112, 114 and out top side 118 and through channels 120, 122. Directing attention to FIG. 4, the formation of channels 130, 132 in bottom side 116 also creates a trimeran profile in bottom side 116, composed of left rail 136 disposed proximate to left side 106, right rail 138 disposed proximate to right side 108, and center raised profile 140 disposed between channels 130, 132.

It is to be understood that a variety of modifications can be utilized with the various embodiments of the present invention. For example, apertures 112, 114 can be disposed at various distances from tail end 104, depending on performance requirements of the individual rider, or overall length of surfboard 100, or shape of tail end 104. Likewise, tail end 104 can be shaped in a variety of traditional configurations found on various designs of surfboards, such as pin tail 140 (FIG. 5), round 142 (FIG. 6), fish tail 144 (FIG. 7), bat tail 146 (FIG. 8), and diamond or flat tail 148 (FIG. 9). Again, as with placement of apertures 112, 114, the shape of tail end 104 depends on the rider's preference, overall length of surfboard 100, or other desired dimensions of surfboard 100. Also, the rise and curvature of front end 102 and tail end 104 can also be modified depending on rider preference, overall length and style of surfboard 100.

While a surfboard in accordance with the preferred embodiment of the present invention has been illustrated and described in detail, it is to be understood that the foregoing detailed description is exemplary in nature, and many changes and modifications can be made to the present invention without departing from the spirit thereof.

What is claimed is:

1. A surfboard having a length defined by a front end and a tail end, and a thickness defined by a bottom side and a top side, the surfboard comprising:

first and second apertures extending through the surfboard from the bottom side to the top side, the apertures angled such that both apertures have a first opening on the bottom side and extends at an angle toward the tail end of the surfboard to a second opening on the top side of the surfboard, the second opening closer to the tail end of the surfboard than the first opening, the second opening closer to the tail end of the surfboard than the first opening, further comprising a first channel and a second channel, the first channel disposed within a portion of the bottom side of the surfboard, and terminating at the first opening of the first aperture, and the second channel disposed within a portion of the bottom side of the surfboard, and terminating at the first opening of the second aperture, the first channel and second channel separated by a raised portion of the bottom side, thus defining a trimeran profile on the bottom side, the trimeran profile having a first rail, a second rail, and a center portion.

2. The surfboard of claim 1, further comprising a third channel disposed on the top side of the surfboard, behind the first aperture and extending toward the tail end of the surfboard.

3. The surfboard of claim 1, further comprising a fourth channel disposed on the top side of the surfboard, behind the second aperture and extending toward the tail end of the surfboard.

4. The surfboard of claim 1, wherein the first aperture and second aperture are located at substantially equal distances from the tail end.

5. The surfboard of claim 1, wherein second opening of the first opening of the first aperture and the second opening of the second aperture are located approximately 12.5 inches from the tail end.

6. The surfboard of claim 1, wherein the surfboard further comprises at least one skag attached to the bottom side proximate to the tail end.

7. The surfboard of claim 1, wherein the top side incorporates a curvature, the curvature defined by the front end raised above the center of the top side, tail end raised above the center of the top side.

8. The surfboard of claim 1, wherein the first channel and second channel begin approximately 18.5 inches from the front end.

9. The surfboard of claim 1, wherein the surfboard comprises a foam core covered by an outer shell of epoxy, fiberglass and resin.

10. The surfboard of claim 1, further comprising a stringer, the stringer incorporating a wooden spline in the center of the width of the surfboard and extending through a portion of the length of the surfboard.

11. The surfboard of claim 1, wherein the first aperture and second aperture are disposed at an angle, the angle sufficient to provide a vertical clearance between the bottom side and top side.

12. The surfboard of claim 1, wherein the tail end comprises a pin tail design.

13. The surfboard of claim 1, wherein the tail end comprises a diamond tail design.

14. The surfboard of claim 1, wherein the tail end comprises a round tail design.

15. The surfboard of claim 1, wherein the tail end comprises a fish tail design.

16. The surfboard of claim 1, wherein the tail end comprises a bat tail design.

* * * * *